United States Patent [19]

Meek et al.

[11] Patent Number: 5,010,958

[45] Date of Patent: Apr. 30, 1991

[54] MULTIPLE CUP BRIDGE PLUG FOR SEALING A WELL CASING AND METHOD

[75] Inventors: Dale E. Meek, Sugarland; Merlin D. Hansen, Missouri City, both of Tex.

[73] Assignee: Schlumberger Technology Corporation, Houston, Tex.

[21] Appl. No.: 533,624

[22] Filed: Jun. 5, 1990

[51] Int. Cl.[5] ..... E21B 33/128; E21B 33/129

[52] U.S. Cl. ..... 166/382; 166/134; 166/195; 166/196; 166/202; 166/387

[58] Field of Search ..... 166/202, 121, 196, 195, 166/192, 134, 127, 382, 387

[56] References Cited

U.S. PATENT DOCUMENTS

| | | | |
|---|---|---|---|
| Re. 32,831 | 1/1989 | Shonrock et al. | 166/192 |
| 1,895,905 | 1/1933 | Young | 166/195 X |
| 2,207,448 | 7/1940 | Ashbrook | 166/195 X |
| 2,217,038 | 10/1940 | Alley | 166/195 X |
| 2,253,776 | 8/1941 | Gaunt | 166/196 X |
| 2,301,191 | 11/1942 | Boynton | 166/195 X |
| 2,612,953 | 10/1952 | Morgan et al. | 166/196 X |
| 4,554,973 | 11/1985 | Shonrock et al. | 166/135 |

*Primary Examiner*—Stephen J. Novosad

*Attorney, Agent, or Firm*—Henry N. Garrana; John H. Bouchard

[57] ABSTRACT

A bridge plug for sealing a well casing comprises a plurality of cups which tightly interfit together when a compressive load is applied to both opposite ends of the plurality of cups. Application of the compressive load to both opposite ends of the cups forces a first cup to fit into a second cup, the second cup to fit into a third cup, and the third cup to fit into a fourth cup, etc., thereby producing a single unitary plug which includes a plurality of tightly interfit cups. Further application of the compressive load to both opposite ends causes transverse expansion of the plurality of interfit cups to occur. When the cups contact the well casing wall, a permanent seal is achieved between the cups and the well casing wall. Anchor elements on both sides of the cups contact the well casing wall and permanently hold the interfitting cups in their compressed condition.

19 Claims, 7 Drawing Sheets

FIG.10
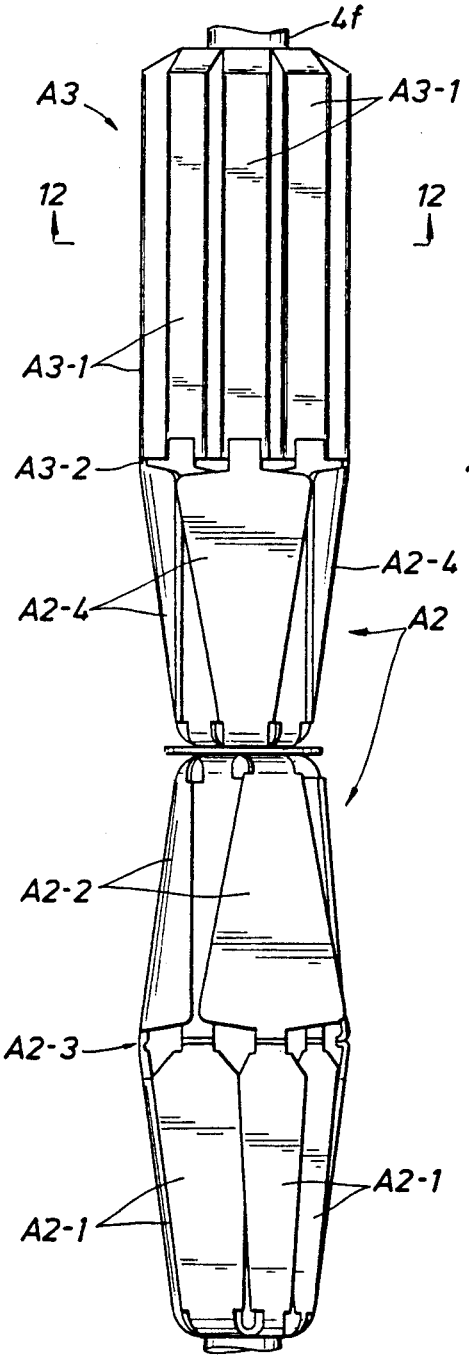
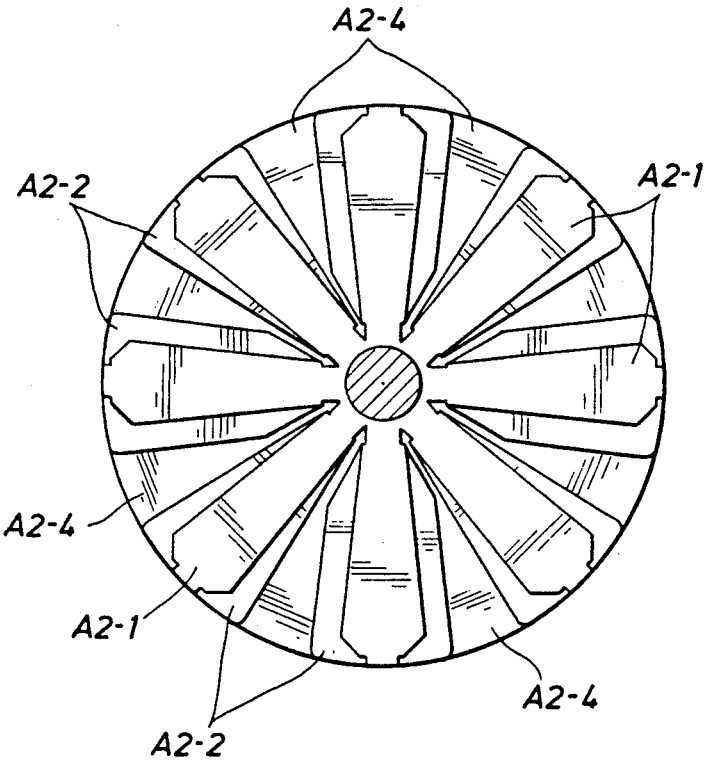
FIG.11
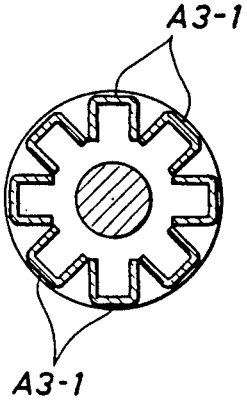
FIG.12

MULTIPLE CUP BRIDGE PLUG FOR SEALING A WELL CASING AND METHOD

BACKGROUND OF THE INVENTION

The subject matter of the present invention relates to an apparatus for sealing a well casing, and more particularly, to a multiple cup stuffer through tubing bridge plug for sealing a perforated well casing when hydrocarbon well fluids cease to flow from the perforated casing.

When a well casing is perforated, hydrocarbon fluids flow from the perforated casing. Frequently, a particular formation, from which hydrocarbon fluids had previously been flowing, ceases to flow the desired hydrocarbons, but rather undesired fluids, such as water, begin to flow into the casing. If another formation exists adjacent the casing, such formation being located above the first formation which is now flowing the undesired fluids, the casing is sealed above the first group of perforations. Thereafter, the casing is again perforated along its length adjacent the second formation from which hydrocarbon fluids are desired to be produced. A sealing apparatus is normally suspended by wireline, the sealing apparatus sealing the casing above the first group of perforations. One such sealing apparatus is disclosed in U.S. Pat. No. 4,554,973 to Shonrock, et al, assigned to the same assignee as that of the present invention. The Shonrock sealing apparatus is an elastomeric sealing element for a bridge plug; however, due to its appearance, it is commonly known as a "football". The shonrock football sealing apparatus possessed a low temperature rating relative to the current needs of the logging industry. In addition, the football is expensive to manufacture. Furthermore, if it is necessary to seal a well casing, it is desirable to use the same sealing apparatus for different sized well casings. However, it is very difficult if not impossible to manufacture the football sealing apparatus in larger sizes Therefore, it is very difficult if not impossible to use the Shonrock football sealing apparatus for different sized well casings.

SUMMARY OF THE INVENTION

Accordingly, it is a primary object of the present invention to provide a new and novel sealing apparatus for sealing a well casing which has a high temperature rating, is inexpensive to manufacture, may selectively and easily be constructed in different sizes using present manufacturing technology and may therefore be used to seal different sized well casings.

It is a further object of the present invention to provide a new multiple cup sealing apparatus which comprises a plurality of successively sized cups of different diameters, each cup being adapted to fit inside a successively larger cup, the size of the multiple cup sealing apparatus depending upon the number of successively sized cups interfit together to form the multiple cup sealing apparatus.

It is a further object of the present invention to apply a first compressive load to one side of the multiple cup sealing apparatus and to apply a second compressive load to the other side of the multiple cup sealing apparatus, the first and second compressive loads forcing the number of successively sized cups to deploy then interfit together thereby forming the multiple cup sealing apparatus of the present invention.

It is a further object of the present invention to provide a novel platform means disposed on both sides of the multiple cup sealing apparatus for applying the compressive force to both sides of the multiple cup sealing apparatus in response to the application thereto of the compressive force, each of the platform means including a petal and buttress backup which deploys in response to the application thereto of the compressive force.

It is a further object of the present invention to provide a novel anchor apparatus disposed behind each of the petal and buttress backups for anchoring each of the petal and buttress backups to a casing when the backups are disposed in a selected position in the wellbore.

It is a further object of the present invention to provide novel designs for the petal and buttress backups and for the novel anchor apparatus.

In accordance with these and other objects of the present invention, a novel sealing apparatus comprises a plurality of cups, each cup being slightly larger in size or diameter than its immediately preceeding successively sized cup, a first back-up disposed on one side of the plurality of cups, a second back-up disposed on the other side of the plurality of cups, and a means for applying a first and second compressive load to the first and second back-up, respectively, the first back-up and the second back-up compressing the plurality of cups until a single plug is created, the single plug sealing a perforated well casing when the plug is disposed adjacent the perforated well casing in a wellbore. The first and second back-ups each include a petal backup for applying a compressive force to each side of the plug when the petal backup is deployed, and a buttress backup for applying a compressive force to each side of the petal backup when the buttress backup is deployed, the petal and buttress backups contacting the well casing when deployed thereby functioning to provide strength and extrusion prevention. A multitooth anchor arm is disposed behind each buttress backup for anchoring the plug to the wellbore casing and maintaining the plug in its deployed and sealing condition regardless of the condition of the casing. In addition, the anchor arms ensure uniform deployment and centralization in the borehole. Since the deployment force of each multi-arm anchor is lower than the deployment force required to deploy the buttress and petal backups and the cup elements, the anchor deploys before the buttress backup, the petal backup, and the cup elements deploy.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIG. 10 illustrates a construction of the petal and buttress backups of FIGS. 8 and 9;

FIG. 11 illustrates a top view showing the petal backup of FIG. 10 when the petal backup is in its deployed condition;

FIG. 12 illustrates a cross sectional view of the buttress backup of FIG. 10 when disposed in its non-deployed condition;

DETAILED DESCRIPTION OF THE PREFERRED EMBODIMENT

Figure 1:
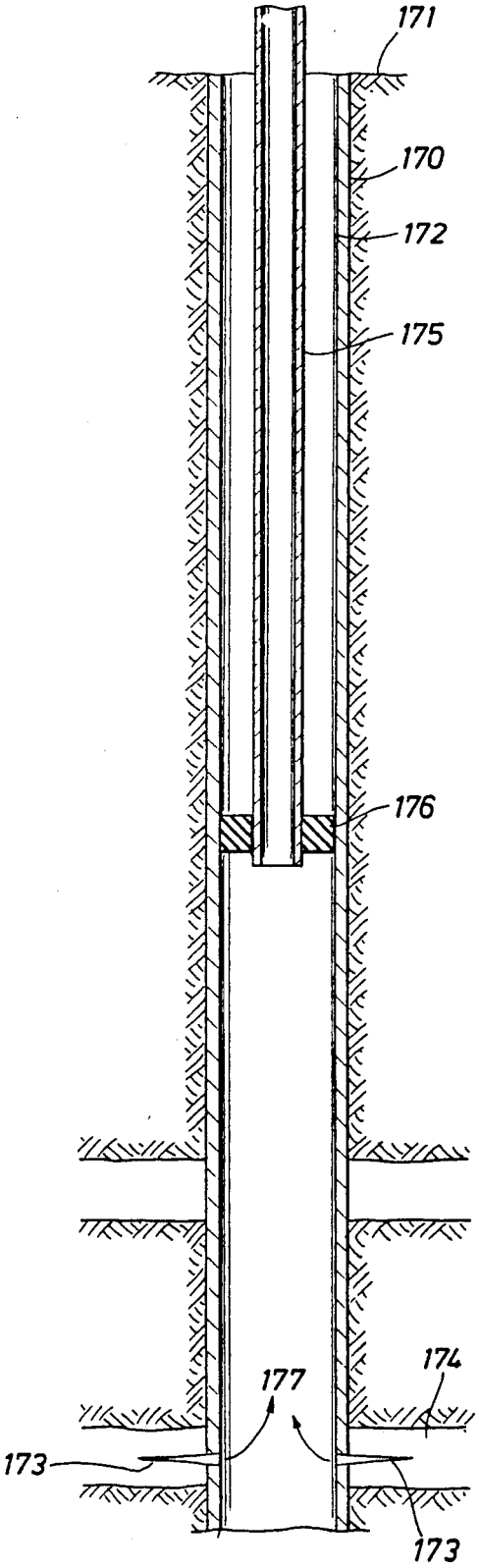
FIGS. 1 and 2 are partial cross sectional views along the longitudinal axis of a well bore schematically illustrating the intended use of the method and apparatus in providing a plug or seal in the borehole in accordance with the present invention.
Figure 2:
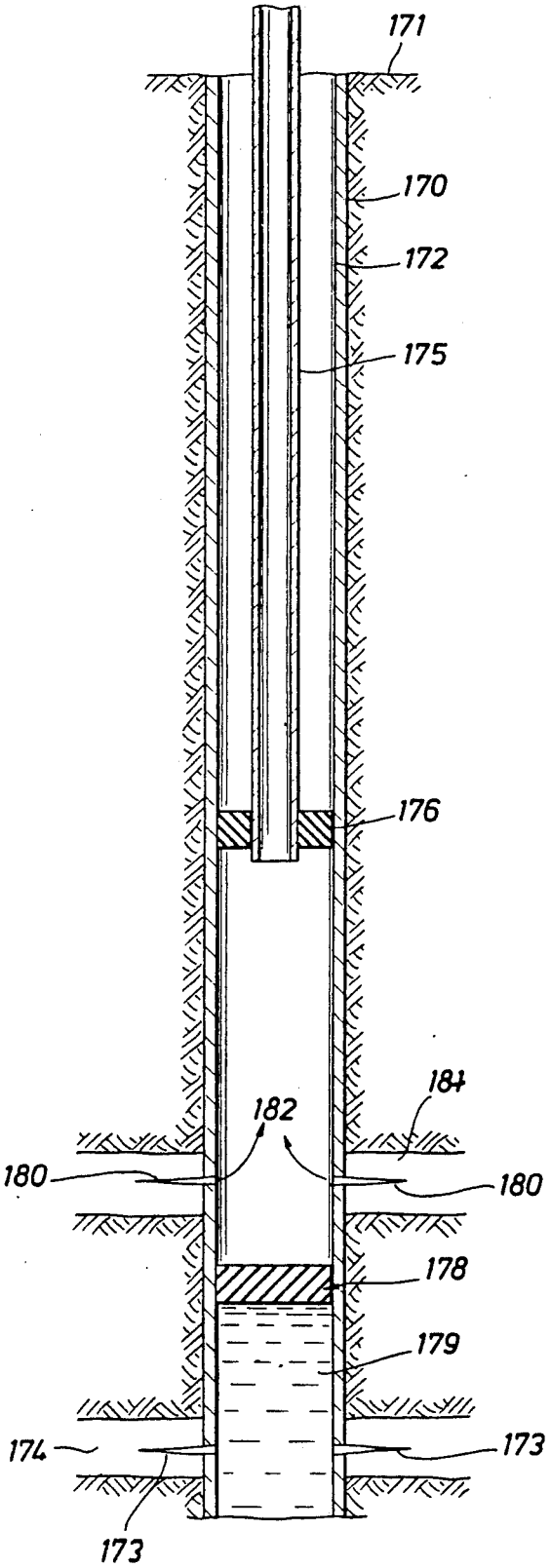

In FIGS. 1 and 2, a borehole 170 is disposed in the earth's surface 171, which borehole 170 has been provided with a conventional well casing 172. As shown in FIG. 1, a first set of perforations 173 have been provided in well casing 172 adjacent a hydrocarbon producing formation 174. Conventional production tubing 175 having a diameter less than the diameter of the well casing 172, is disposed within well casing 172 and is sealed about its end in a conventional manner as by a packer 176. The hydrocarbons, as illustrated by arrows 177, flow upwardly to the earth's surface 171 via production tubing 175. Upon the formation 174 producing undesired fluids, such as water, it becomes necessary to seal well casing 172 at a depth disposed above the first set of perforations 173. With reference to FIG. 2, a seal, or plug, shown schematically as 178, is disposed within well casing 172 above the first set of perforations 173 adjacent formation 174, which now has water 179 and/or other undesired fluids flowing through perforations 173. After seal, or plug, 178 has been disposed within well casing 172, perforations 180 are provided in a conventional manner in well casing 172 adjacent another hydrocarbon producing formation 181, through which hydrocarbons 182 may flow upwardly through production tubing 175, as previously described. In order to most efficiently, expeditiously, and economically provide seal 178 in well casing 172, it is necessary to utilize a device capable of passing through the reduced diameter production tubing 175.

Figure 3:
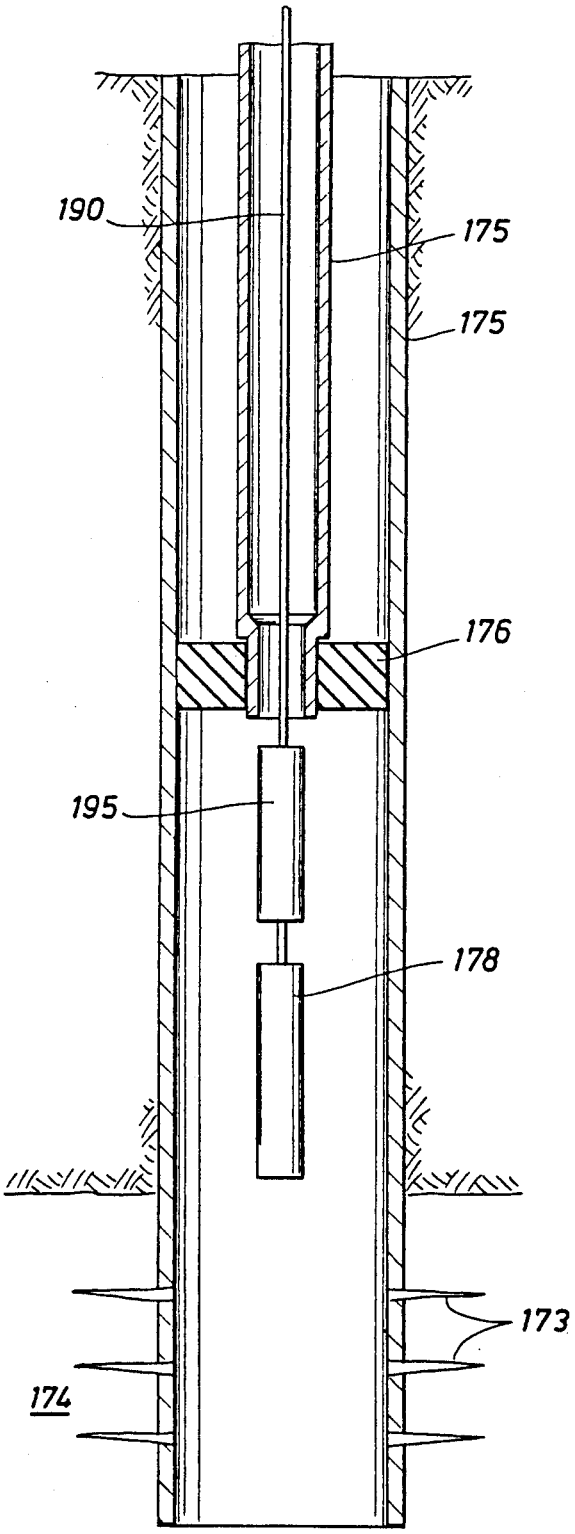
FIGS. 3 and 4 illustrate the method by which the plug or seal is first disposed in the borehole by wireline.
Figure 4:
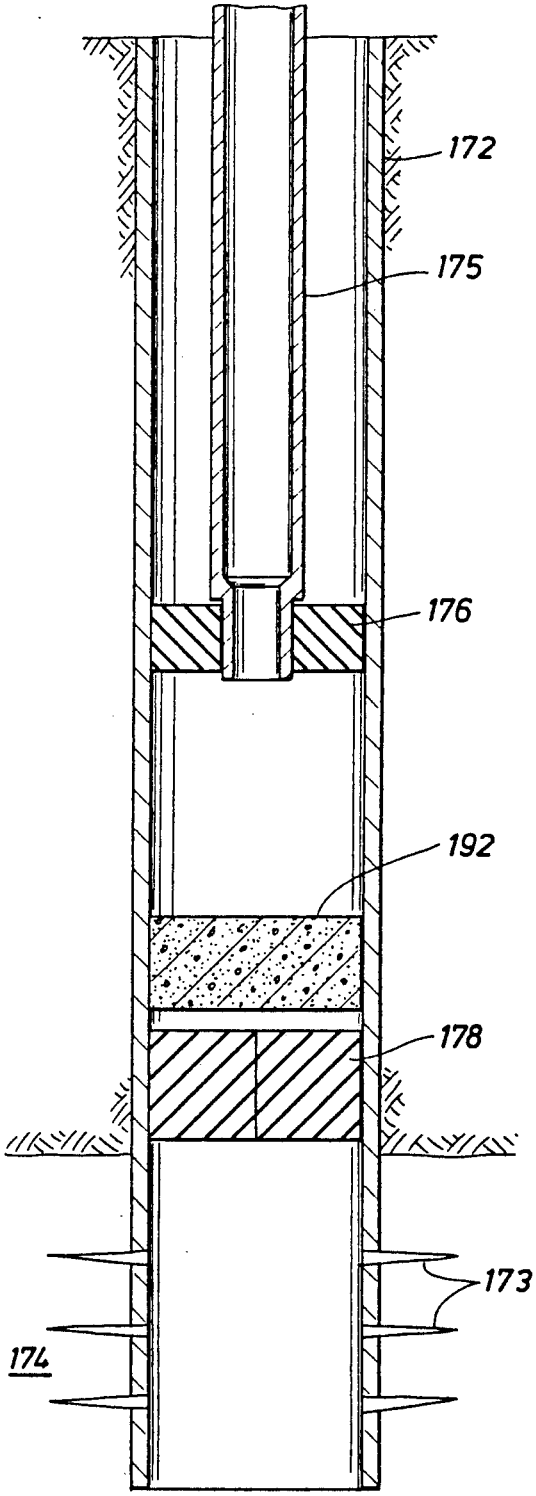

Referring to FIGS. 3 and 4, the method by which plug 178 is placed in borehole 170 is illustrated.

In FIG. 3, plug 178 and a setting tool 195 are suspended by wireline or coil tubing 190 within production tubing 175, the plug 178 being compressed to a size which is smaller than the inside diameter of the production tubing 175 around packer 176, or any other restrictions. The plug 178 of FIG. 3 is lowered through production tubing 175 until it passes completely through the tubing 175 and is disposed immediately above perforations 173 of hydrocarbon producing formation 174.

In FIG. 4, the plug 178 is expanded in size until it presses firmly against the casing 172, thereby functioning as a plug or seal for sealing off the borehole adjacent formation 174 below the plug from the remaining portion of borehole 170. As a result, the undesirable fluids, such as water, flowing from perforations 173 cannot access the production tubing 175 and mix with the other desirable hydrocarbon well fluids being produced from perforations 180. If desired, a cement layer 192 may be disposed over the plug 178 for increasing the pressure rating and assisting the plug 178 in sealing off the borehole adjacent formation 174 below the plug 178 from the remaining portion of the borehole 170 above plug 178.

Figure 5:
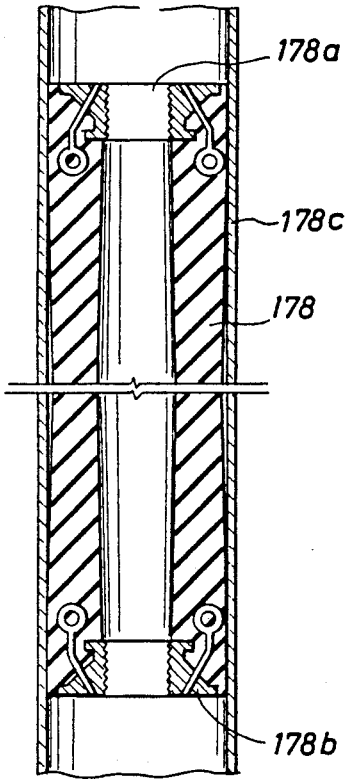
FIG. 5 (PRIOR ART)
FIGS. 5 through 7 a prior art sealing apparatus representing the plug or seal of FIGS. 1-4.
Figure 6:
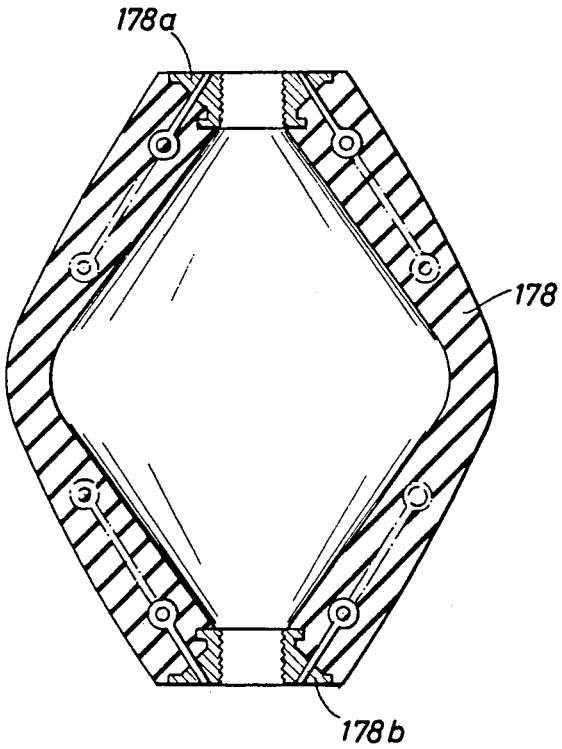
FIG. 6 (PRIOR ART)
Figure 7:
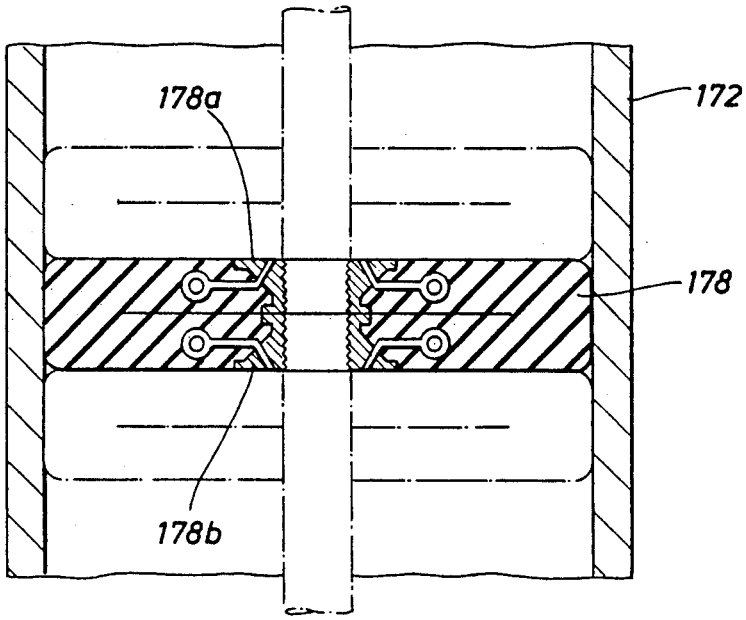
FIG. 7 (PRIOR ART)

Referring to FIGS. 5 through 7, a prior art plug 178, set forth in U.S. Pat. No. 4,554,973 and Re 32,831, is illustrated.

In FIG. 5, the plug 178, suspended by wireline or coiled tubing, has elements pulled into sleeves 178*c* during manufacturing. When the plug elements exit the sleeves 178*c*, they are deployed by a setting tool to football shapes, as shown in FIG. 6, by applying a compressive load to both ends. When it is desired to plug the perforations 173 which are producing the unwanted fluid, such as water, instead of the wanted hydrocarbon material, the two ends 178*a* and 178*b* of two or more football shaped plugs 178 of FIG. 6 are compressed tightly together to produce the plug of FIG. 7. However, as noted in the background section of this specification, the football shaped plug of FIGS. 5-7 is virtually impossible to manufacture in larger sizes. Since it is desirable to use the plug 178 for different sized cased boreholes, the plug of FIGS. 5-7 could not be used for the larger sized cased boreholes, since it was virtually impossible to manufacture the plug of FIGS. 5-7 in larger sizes.

Figure 8A:
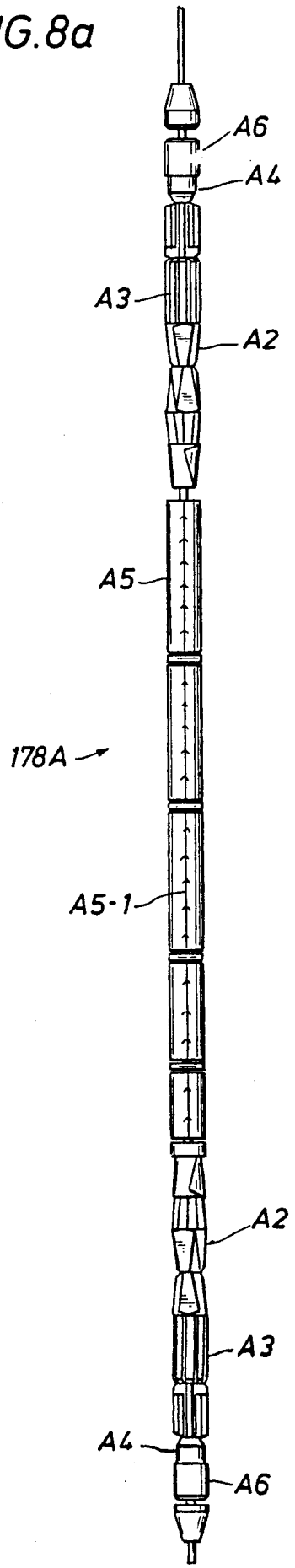
FIGS. 8*a*-8*b* illustrate a novel sealing apparatus representing the plug or seal of FIGS. 1-4 in accordance with the present invention when the multi-cup plug is not deployed and is ready to be inserted into a well tubing and when the multi-cup plug has entered the wellbore casing, the anchors and petals have deployed, the cups have broken out of their sleeves, and the multi-cup plug has partially deployed.
Figure 8B:
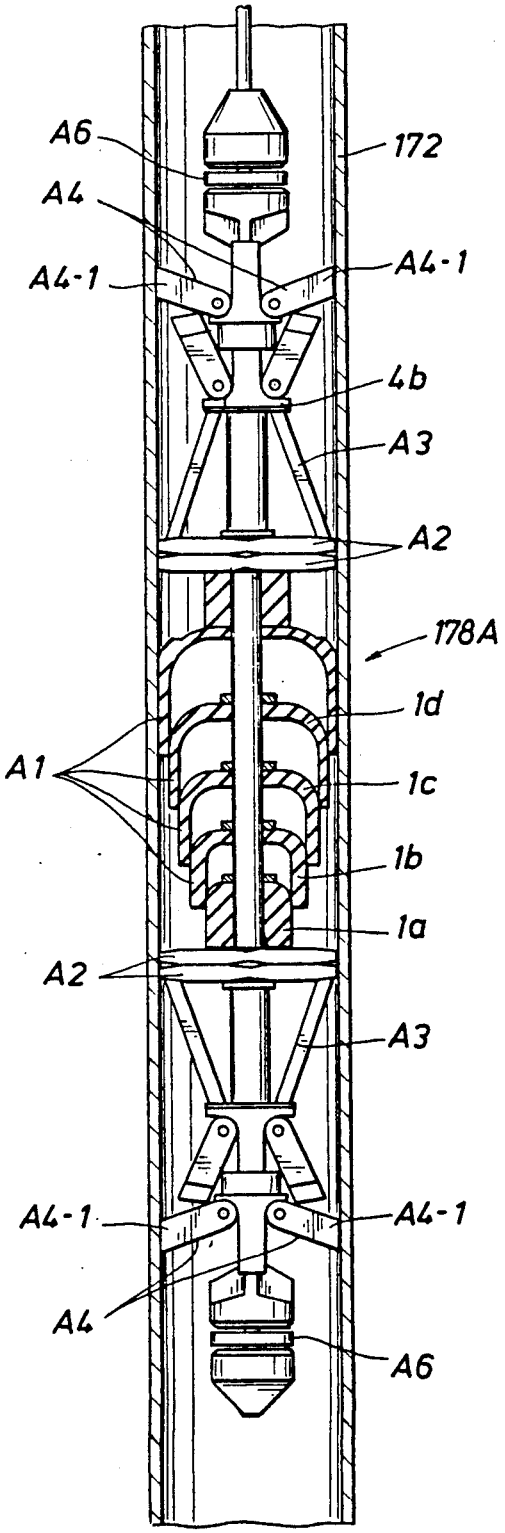

Referring to FIGS. 8*a*-8*b*, a novel plug or sealing apparatus 178A in accordance with the present invention is illustrated in FIG. 8*a* in its pre-deployment condition and includes a plurality of cup seal elements, the cup elements being disposed within sleeves for transport within the production tubing 175, and in FIG. 8*b* in its deployed condition prior to the final application thereto of the compressive force on both sides of the sealing apparatus.

In FIG. 8*a*, the novel plug or sealing apparatus 178A in accordance with the present invention is illustrated in its pre-deployment condition. The plug 178A cup seal elements A1 are disposed within a sleeve A5. The sleeve A5 is manufactured with a seam A5-1 running longitudinally along its length. The seam A5-1 allows the sleeve A5 to split apart longitudinally along its length when a compressive load is applied to both ends of the plug 178A and an internal radially directed force is applied to an inner wall surface of the sleeve A5. Undeployed petal backups A2 are disposed on both sides of the sleeve A5, and an undeployed buttress backup A3 is disposed adjacent each undeployed petal backup A2. An undeployed anchor element A4 is disposed adjacent each undeployed buttress backup A3. A mandrel lock A6 is disposed adjacent each undeployed anchor element. Each of these structural components of the sealing apparatus of the present invention will be described in further detail in this specification.

In FIG. 8*b*, the novel plug or sealing apparatus 178A is shown in its deployed condition prior to the final application thereto of a compressive force. The sealing apparatus 178A includes a plurality of stuffer cup seal elements A1 which are inserted into sleeve A5 during manufacturing, deployed petal backups A2 disposed on both sides of the cup eleme- s A1, deployed buttress backups A3 disposed on both sides of the petal backups A2, and deployed anchors A4 disposed on both sides of the buttress backups A3. Each of the petal backups A2 are shown in a deployed condition; when deployed, each of the petal backups A2 contact the well casing 172; this prevents an extrusion of the cup elements A1 from their location between the deployed petal backups A2 when a compressive force is applied to both petal backups A2. The compressive force nests the cups together and squeezes them against the casing wall, thereby affecting the seal. Each of these elements will be shown and described in more detail in the following paragraphs.

In FIG. 8*a*, when the sealing apparatus 178A is disposed in a well casing 172, a compressive force is applied to both ends of the sealing apparatus 178A. In response to this compressive force, the anchors A4 are first to deploy. The petal/backups A2 are next to deploy, and the buttress backups A3 are the last to deploy. Following deployment of the buttress and petal backups A3 and A2, the compressive force creates an internal radially directed force within the sleeve A5. The force is radially directed, the sleeve A5 splits apart along its seam A5-1. When the sleeve splits apart along seam A5-1, the plug 178A assumes the deployed condition shown in FIG. 8*b*. However, the final compressive load to nest and seal the stuffer cup elements A1 has not yet been applied to the plug 178A of FIG. 8*b*.

In FIG. 8*b*, each of the plurality of cup seal elements A1 is made of rubber and is shaped in the form of a cup, a smaller cup being sized to fit within a next larger sized cup. For example, smaller cup 1*a* fits within the next larger sized cup 1*b*, cup 1*b* fitting within next larger sized cup 1*c*, cup 1*c* fitting within next larger sized cup 1*d*, etc. When deployed, a petal back-up assembly A2 is disposed on both sides of the plurality of cup elements A1. When deployed, each petal back-up A2 contacts a wall of the well casing 172 and functions as a platform for transmitting a compressive force to the plurality of cup elements A1 when the compressive load is applied to the back-ups A2.

Since the deployed petal back-ups A2 contact the well casing 172 wall, the cup elements A1 cannot extrude from within the interspace located between adjacent petal backups A1 when the compressive force is applied to the back-ups A2. A buttress back-up assembly A3, which includes a plurality of buttress legs A3-1 of FIG. 10, is disposed behind each petal back-up assembly A2 and is adapted to deploy when a compressive load is applied thereto. An anchor element A4 is disposed behind each buttress backup A3 for anchoring the deployed plug to the casing 172 thereby holding the plug in the deployed and sealing position within the wellbore in response to the application thereto of the compressive force. A mandrel lock A6 is also used to lock the components in the compressed state. Therefore, if the anchors A4 slide in response to a differential pressure, the whole plug assembly will move without relieving the compressive load on the elements. Anchor teeth A4-1 on the anchor elements A4 firmly grip the well casing 172 thereby holding the buttress backup A3, the petal backup A2 and the plurality of cups A1 in their respective deployed and/or compressed positions within the wellbore.

The plug 178A in FIG. 8*b* is shown in its deployed condition prior to the application thereto of the final compressive force on both sides of the sealing apparatus 178A. In this condition, the cup seal elements A1 have not yet been compressed tightly together to form a single sealing plug, such as the single plug 178 illustrated in FIGS. 2 and 4.

Figure 9A:
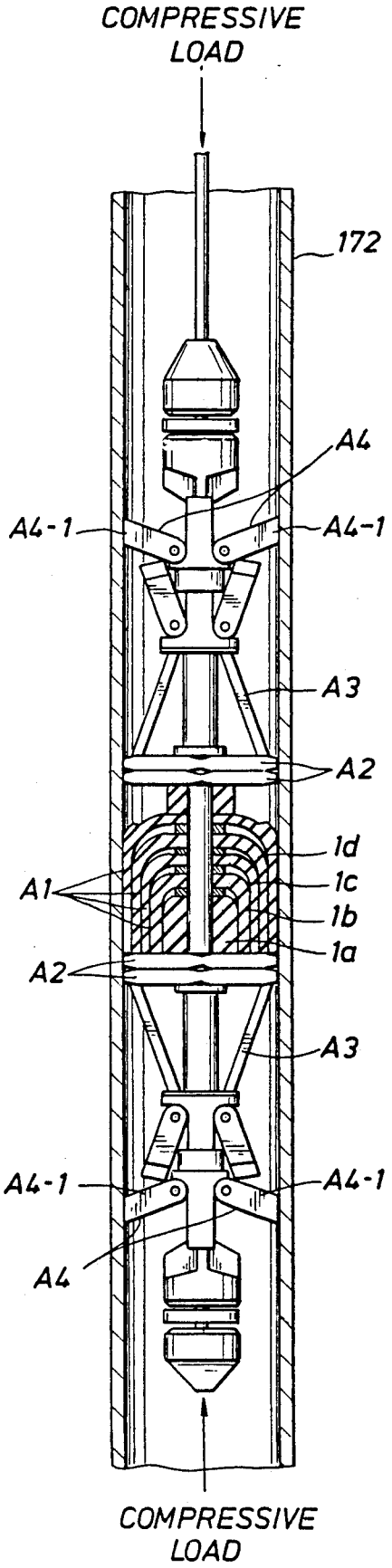
FIGS. 9*a*-9*b* illustrate the novel sealing apparatus of FIGS. 8*a*-8*b* when the multi-cup plug is being successively deployed in the wellbore casing.
Figure 9B:
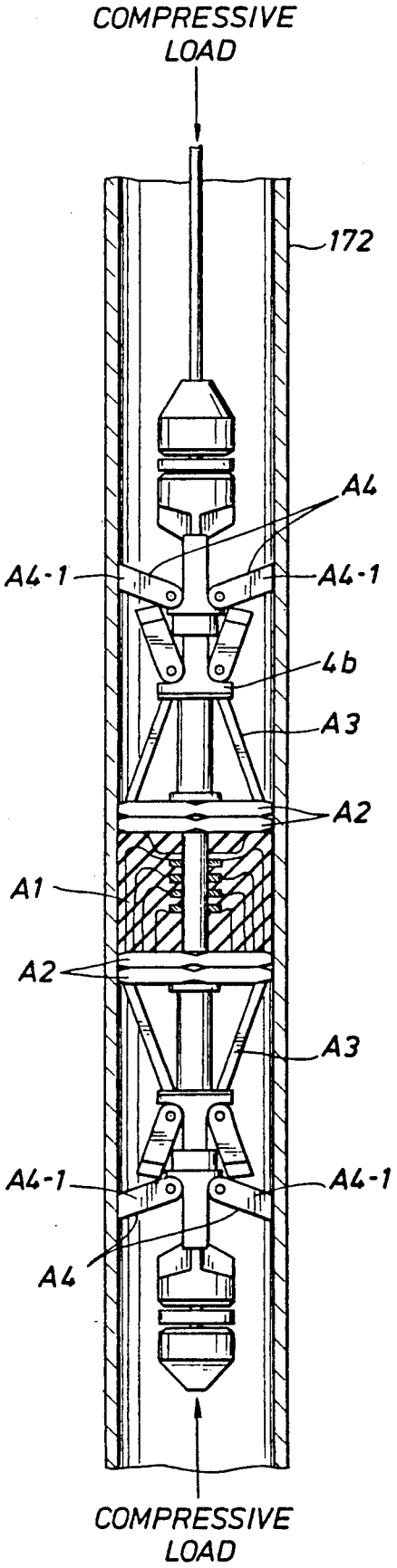

Referring to FIGS. 9*a*–9*b*, the novel plug or sealing apparatus 178A in accordance with the present invention is illustrated in its deployed and partially compressed condition (FIG. 9*a*) and in its deployed and totally compressed condition (FIG. 9*b*). As shown in FIG. 9*b*, when totally compressed, the cup seal elements A1 are compressed together to form a single sealing plug, such as the single plug 178 shown in FIGS. 2 and 4.

Since an outer periphery of the deployed petal backups A2 contact a surface of the well casing 172, the compressed cup seal elements A1 cannot extrude from within the interspace located between the deployed petal backups A2.

A functional operation of the present invention will be set forth in the following paragraphs with reference to FIGS. 8*a*–8*b* and 9*a*–9*b* of the drawings.

A pressure or electrical signal is transmitted to the setting tool 195 of FIG. 3, the setting tool 195 applying a longitudinal compressive load to the plug assembly 178A. Starting with the sealing apparatus 178A of FIG. 8*a*, (1) the compressive load first deploys the upper anchor thereby preventing the plug from moving upward in the casing 172; teeth A4-1 of anchor A4 grip the casing 172 When the anchor elements A4 are completely deployed; (2) second, the compressive load then deploys the back up petal A2 and buttress A3 backups disposed on the upper side of the cup elements A1, which prevents extrusion of the elastomeric cups Al from differential pressure and form a platform by which a uniform compressive load is applied to the deployed cups A1 for affecting a complete footprint and seal on the well casing 172 wall; FIG. 9*a* shows the anchor elements A4, buttress backup A3 and petal backup A2 in their respective deployed condition; the lower petal and backup may deploy here or as part of step (6); (3) third, when the compressive load is further increased, the sleeve A5 splits along its seam A5-1; (4) fourth, the cups A1 deploy in roughly decending order from their respective sleeves thereby resulting in the sealing apparatus shown in FIG. 8*b* of the drawings; (5) fifthly, the cups A1 are "stuffed" together to form a partial mass of rubber, as shown in FIG. 9*a*; (6) sixth, the lower anchor A4 deploys at this point or sooner thereby firmly affixing the plug of FIGS. 8 and 9 to the casing 172 and preventing any movement; and (7) seventh, the cups A1 are further "stuffed" together to form a solid mass of rubber, in an artful manner, as shown in FIG. 9*b* of the drawings. In particular, when it is desired to plug the well, similar to the plug 178 shown in FIG. 2, the anchors, buttress back-ups A3 and petal back-ups A2 approach one another. As they approach one another, the cup elements A1 compress tightly together, sealing the well casing 172. As a result, cup 1*a* fits within cup 1*b*, cup 1*b* fitting within cup 1*c*, and cup 1*c* fitting with cup 1*d*, etc. The final resultant plug or sealing apparatus 178A of the present invention is shown in FIG. 9*b*.

Referring to FIGS. 10 through 13, a construction of the petal back-ups A2 and the buttress backups A3 of FIGS. 8*a*–8*b* and FIGS. 9*a*–9*b* is illustrated.

In FIG. 10, the petal and buttress backup assemblies A2 and A3 are shown in their pre-deployment positions. The petal back-up assembly A2 includes a first plurality of petal assembly petals A2-1 and a second plurality of petal assembly petals A2-2 hinged to the first plurality of petal assembly petals A2-1 via the hinge or joint A2-3, and a third plurality of petal assembly petals A2-4 connected to the second plurality of petal assembly petals A2-2. The hinge A2-3 is intended to include any structure which will allow a first petal assembly petal A2-1 to rotate with respect to a second petal assembly petal A2-2 along a point interconnecting the two petals herein designated as a "hinge" A2-3. The buttress assembly A3 includes a first plurality of buttress assembly legs A3-1 hinged to the third plurality of petal assembly petals A2-4 via another hinge A3-2. The hinge A3-2 is defined in the same terms as hinge A2-3.

In FIG. 11, a top view of the petal back-up A2 assembly of FIG. 10 is illustrated in its deployed position, the top view illustrating the petal assembly petal A2-1 on top of petal assembly petal A2-2, the combined petal assembly petals A2-1/A2-2 being interleaved in the figure with the petals A2-4. The buttress legs A3-1 are not shown in the top view of FIG. 11, since the legs A3-1 are disposed below the petals A2-1/A2-2/A2-4 in the figure.

FIG. 12 is a cross sectional view of the buttress assembly A3 buttress legs A3-1 taken along section lines 12—12 of FIG. 10.

Figure 13:
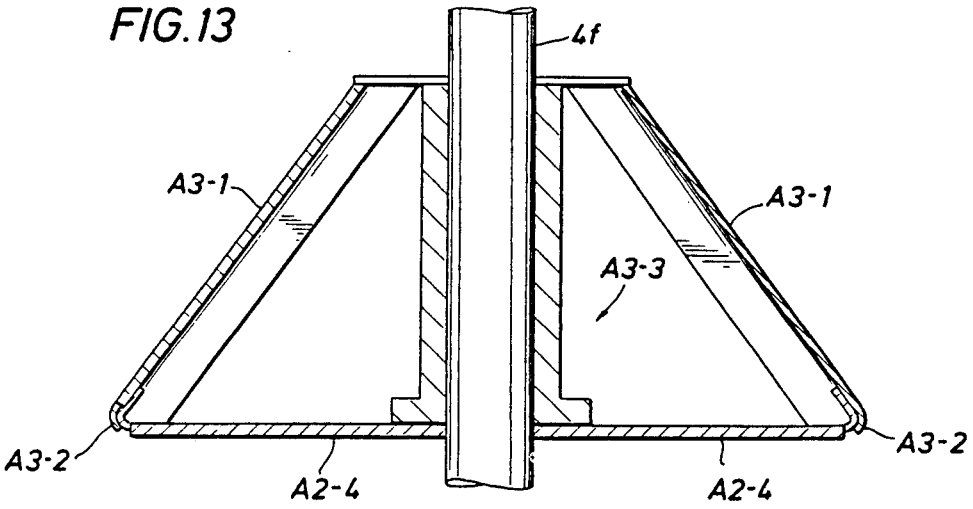
FIG. 13 illustrates a side view of the buttress backup assembly of FIG. 10 when the buttress petals are deployed.

In FIG. 13, the buttress assembly A3 is shown in its deployed condition; that is, the petal assembly petals A2-4 have rotated approximately 90 degrees to a deployed position, the buttress legs A3-1 being hinged to the petals A2-4 via hinge A3-2 and deploying to the position shown in the figure in response to rotation of the petals A2-4 as shown. When the petal assembly petals A2-4 have finished rotating, the petals A2-4 are disposed approximately perpendicular to a rod 4*f* running through the longitudinal center of the plug, the buttress legs A3-1 and a spacer A3-3 supporting the petal assembly petals A2-4 in their deployed position.

Figure 14:
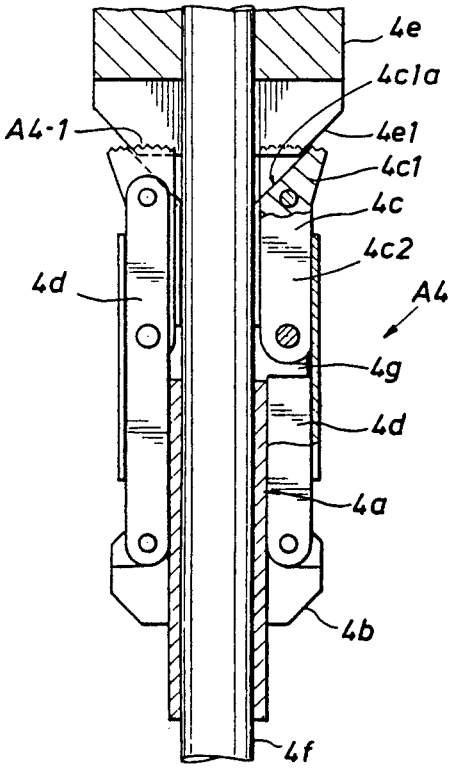
FIGS. 14 and 15 illustrate detailed constructions of the anchor arms of FIGS. 8 and 9.
Figure 15:
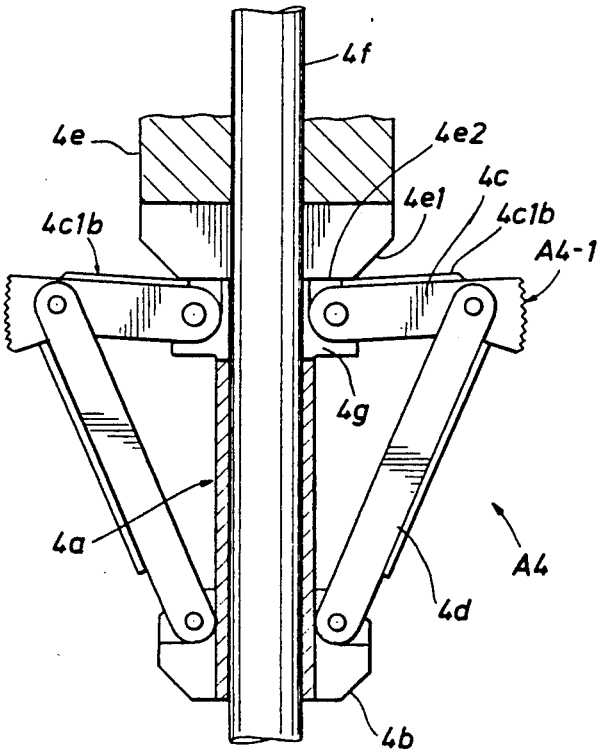

Referring to FIGS. 14 and 15, a construction of the anchor elements A4 of FIGS. 8*a*–8*b* and 9*a*–9*b* is illustrated.

In FIG. 14, an anchor element A4 is shown in its non-deployed condition; whereas, in FIG. 15, the anchor element A4 is shown in its deployed condition. The anchor element A4 includes a center rod 4*f*, a body 4*a* slidable with respect to the rod 4*f*, a slide 4*b* adapted to slide over the end of the body 4*a*, a backup arm 4*d* having one end pinned to the slide 4*b* and the other end pinned to an anchor arm 4*c*, the anchor arm 4*c* having one end pinned to the other end of the backup arm 4*d* and one end pinned to the body 4*a* at location 4*g*. A cam 4*e* is slidable with respect to rod 4*f*. In FIG. 14, the cam 4*e* includes an angled surface 4*e*1 and a flat surface 4*e*2; and the anchor arm 4*c* includes an intermediate plate 4*c*1 disposed between two outer plates 4*c*2. The outer plates 4*c*2 each include teeth A4-1 disposed on an outer end for gripping the casing in the borehole. The intermediate plate 4*c*1 also includes an angled surface 4*c*1*a* which coincides with the angled surface 4*e*1 of the cam 4*e* and a flat surface 4*c*1*b* (see FIG. 15) which lies along the longitudinal axis of the anchor arm 4*c*.

A functional operation of the anchor elements A4 will be set forth in the following paragraph with reference to FIGS. 14 and 15 of the drawings. Further, a functional description of the petal assembly A2 and the buttress assembly A3 will be set forth in subsequent paragraphs with reference to FIGS. 8–13, and in particular, FIGS. 10–13.

When the cam 4*e* slides along rod 4*f* and travels downwardly in FIG. 14, the angled surface 4*e*1 of cam 4*e* slides with respect to the angled surface 4*c*1*a* of the intermediate plate 4*c*1 of anchor arm 4*c*; and the flat surface 4*e*2 of cam 4*e* slides with respect to flat surface 4*c*1*b* thereby forcing the anchor arm 4*c* to rotate with respect to the rod 4*f*. Since the anchor arm 4*c* is pinned at location 4*g*, the anchor arm 4*c* rotates with respect to the location 4*g*. Since the backup arm 4*d* is pinned to the anchor arm 4*c* on one end and to the slide 4*b* on the other end, rotation of the anchor arm 4*c* about the location 4*g* forces the backup arm 4*d* to move the slide 4*b* downwardly in FIGS. 14 and 15. When the anchor arms 4*c* rotate, they rotate outwardly relative to the body 4*a* and in unison. The teeth A4-1 of outer plates 4*c*2 of anchor arms 4*c* grip the well casing 172 of FIGS. 8*a*–8*b* an 9*a*–9*b* when the arms 4*c* are disposed in the deployed position of FIG. 15 but fail to grip the well casing 172 when disposed in the nondeployed position of FIG. 14. The anchor teeth A4-1 can grip the casing 172 at intermediate positions of the slide 4*b* relative to rod 4*f* thus making the anchor A4 itself useful for gripping various diameters and conditions of the well casing 172. However, rotation or deployment of anchor arm 4*c* stops when the slide 4*b*, moving downwardly in FIG. 15, abuts against the buttress assembly A3 of FIG. 8*b*. Anchor arms 4*c* are thus prevented from rotating beyond their maximum radial extent by the action of the backup arms 4*d* and slide 4*b* when abutment against buttress assembly A3 occurs.

Referring to FIGS. 10–13, the petal and buttress back-up assemblies A2 and A3 of FIG. 10 deploy after the anchor elements A4 deploy in the manner described above and when a further force is applied to both opposite ends of the petal and buttress back-up assemblies A2 and A3 so as to compress the assemblies. During deployment, the first plurality of petal assembly petals A2-1 rotate via hinge A2-3 with respect to the second plurality of petal assembly petals A2-2 until the first and second petal assembly petals A2-1 and A2-2 nearly touch each other and therefore assume the configuration shown by numerals A2 and A3 in FIGS. 8*a*, 9*a*–9*b* of the drawings; simultaneously, however, the third plurality of petal assembly petals A2-4 rotate with respect to the plurality of buttress legs A3-1, along hinge A3-2, until the third plurality of petal assembly petals A2-4 and the buttress legs A3-1 assume the configuration shown in FIG. 13 of the drawings. When these rotations occur, the petal back up assembly A2 of FIG. 10 appears to assume a "flat plate" shape, roughly the configuration of the petal backup A2 assembly shown in the side views of FIGS. 8*a*–8*b* and FIGS. 9*a*–9*b*. Alternatively, when these rotations occur, a top view of the petal assembly petals A2-1, A2-2, and A2-4, shown in their deployed positions, is illustrated in FIG. 11 of the drawings.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A sealing apparatus for sealing a well casing, comprising:

a plurality of cups of successively larger sizes;

plate means disposed on op· osite ends of said plurality of cups;

means for applying a compressive load to said plate means, said plate means providing a platform from which a further compressive load is applied to opposite ends of said plurality of cups in response to said compressive load applied to said plate means by said means for applying;

anchor means disposed adjacent each said plate means for gripping said well casing when said means for applying applies said compressive load to each said plate means thereby maintaining the application of said further compressive load from said plate means to said opposite ends of said plurality of cups;

the plurality of cups interfitting tightly together to form said sealing apparatus for sealing said well casing when said means applies said compressive load to said plurality of cups, said plurality of cups remaining tightly interfit together and the well casing remaining sealed by the tightly interfit cups when said anchor means grips said well casing.

2. The sealing apparatus of claim 1, wherein said anchor means comprises:

a body slidable with respect to a rod disposed through a center thereof;

an anchor arm rotatably connected on one end to one end of said body and responsive to said compressive load applied thereto by said means for applying;

a slide adapted to slide with respect to said body;

a backup arm connected on one end to the other end of said anchor arm and on the other end to said slide;

said anchor arm rotating about said one end of said body and slidably moving said slide with respect to said body via said backup arm in response to said compressive load applied to said anchor arm by the means for applying.

3. The sealing apparatus of claim 2, wherein said plate means comprises:

a petal assembly including a first plurality of petals, a second plurality of petals, and a third plurality of petals, one end of said second plurality of petals being connected to and rotatable with respect to the first plurality of petals, one end of said third plurality of petals being connected to and rotatable with respect to the other end of said second plurality of petals; and a buttress assembly including a plurality of buttress legs connected to and rotatable with respect to the other end of said third plurality of petals, said one end of said second plurality of petals rotating with respect to said first plurality of petals to form a first plate, said one end of said third plurality of petals rotating with respect to the other end of said second plurality of petals to form a second plate, and said plurality of buttress legs rotating with respect to the other end of said third plurality of petals when said means for applying applies said compressive load to said anchor arm of said anchor means thereby deploying said anchor arm and slidably moving said slide of said anchor means relative to said body via said back up arm.

4. A method of sealing a well casing, a plurality of successively sized cups adapted to interfit together being disposed within said well casing, each cup of the plurality of cups having a side and a top, the side and the top of said each cup together defining a hollow interior within said each cup, comprising the steps of:

applying a compressive load to both ends of said successively sized cups, the top of said each cup entering the hollow interior of a next adjacent cup of a successively larger size during the application of said compressive load, the applying step continuing until said plurality of cups interfit tightly together; and further applying said compressive load to said both ends of the tightly interfitting, successively sized cups until a plug is formed, the plug sealing said well casing.

5. The method of claim 4, further comprising the step of:

anchoring said plug to said well casing thereby maintaining the seal between said plug and said well casing.

6. A sealing apparatus adapted for sealing a well casing, comprising:

a sleeve;

a plurality of objects disposed within said sleeve and adapted to interfit together to form a plug when said objects ar removed from within said sleeve and a compressive load is applied to opposite ends thereof;

undeployed backup means disposed on both sides of said plurality of objects for deploying in response to said compressive load and providing a backup platform from which a further compressive load is applied to said both sides of said plurality of objects, said plurality of objects forming said plug in response to said further compressive load; and undeployed anchor means disposed adjacent each backup means for deploying in response to said compressive load and for anchoring said sealing apparatus to said well casing when deployed thereby maintaining the formation of said plug by said plurality of objects in the absence of said compressive load and maintaining a seal between said plurality of objects and said well casing.

7. The sealing apparatus of claim 6, wherein said sleeve includes a seam, said seam splitting longitudinally along said sleeve when said compressive load is applied to each of the anchor means.

8. The sealing apparatus of claim 7, wherein said undeployed anchor means deploy, said backup means deploy, said seam of said sleeve splits longitudinally along said sleeve, and said plurality of objects deploy from said sleeve in response to said compressive load applied to each end of the anchor means.

9. The sealing apparatus of claim 8, wherein said plurality of objects comprise a plurality of hollow containers of successively larger sizes, a container of the plurality adapted to fit within a next adjacent container of the plurality when said further compressive load is applied thereto, the plurality of containers tightly interfitting together and forming a solid plug when said further compressive load is continuously applied to both sides of said plurality of containers.

10. The sealing apparatus of claim 9, wherein each container of said plurality of containers comprise a cup.

11. The sealing apparatus of claim 6, wherein said anchor means comprises:

a body slidable with respect to a rod disposed through a center hereof;

an anchor arm rotatably connected on one end to one end of said body and responsive to said compressive load applied thereto by said means for applying;

a slide adapted to slide with respect to said body;

a backup arm connected on one end to the other end of said anchor arm and on the other end to said slide;

said anchor arm rotating about said one end of said body and slidably moving said slide with respect to said body via said backup arm in response to said compressive load applied to said anchor arm by the means for applying.

12. The sealing apparatus of claim 11, wherein each said backup means comprises:

a petal assembly including a first plurality of petals, a second plurality of petals, and a third plurality of petals, one end of said second plurality of petals being connected to and rotatable with respect to the first plurality of petals, one end of said third plurality of petals being connected to and rotatable with respect to the other end of said second plurality of petals; and a buttress assembly including a plurality of buttress legs connected to and rotatable with respect to the other end of said third plurality of petals, said one end of said second plurality of petals rotating with respect to said first plurality of petals to form a first plate, said one end of said third plurality of petals rotating with respect to the other end of said second plurality of petals to form a second plate, and said plurality of buttress legs rotating with respect to the other end of said third plurality of petals when said means for applying applies said compressive load to said anchor arm of said anchor means thereby deploying said anchor arm and slidably moving said slide of said anchor means relative to said body via said back up arm.

13. The sealing apparatus of claim 12, wherein said one end of said second plurality of petals contacts said well casing when said one end of said second plurality of petals rotates with respect to said first plurality of petals to form said first plate, said plurality of objects interfitting tightly together to form said plug and the contact between said one end of said second plurality of petals and said well casing preventing an extrusion of said plug from within an interspace defined by the first plate of each said backup means when said compressive load is applied to the deployed backup means.

14. A sealing apparatus for sealing a well casing, comprising:

a plurality of cups of successively larger sizes, each cup of the plurality having a side and a top, the side and the top defining a hollow interior within said each cup; and means for applying a compressive load to said plurality of cups, the top of said cup entering the hollow interior of a next adjacent cup of successively larger size when the means for applying applies said compressive load to said plurality of cups, the plurality of cups interfitting tightly together to form said sealing apparatus for sealing said well casing when said means for applying continues to apply said compressive load to said plurality of cups.

15. The sealing apparatus of claim 14, further comprising:

plate means disposed on opposite ends of said plurality of cups for providing a platform from which a further compressive load is applied to opposite ends of said plurality of cups in response to said compressive load applied to said plate means by said means for applying.

16. The sealing apparatus of claim 15, further comprising:

anchor means disposed adjacent each said plate means for gripping said well casing when said means for applying applies said compressive load to each said plate means thereby maintaining the application of said further compressive load from said plate means to said opposite ends of said plurality of cups, said plurality of cups remaining tightly interfit together and the well casing remaining sealed by the tightly interfit cups when said anchor means grips said well casing.

17. A sealing apparatus for sealing a well casing, comprising:

a plurality of cups of successively larger sizes, each cup of the plurality having a side and a top, the side and the top defining a hollow interior within said each cup; and means for applying a compressive load to said plurality of cups, the top of said each cup entering the hollow interior of a next adjacent cup of successively larger size when the means for applying applies said compressive load to said plurality of cups, the top of said each cup contacting the top of said next adjacent cup when said top of said each cup enters the hollow interior of said next adjacent cup and the means for applying continues to apply said compressive load to said plurality of cups, the plurality of cups interfitting tightly together to form said sealing apparatus for sealing said well casing when said means for applying maintains the application of said compressive load to said plurality of cups.

18. The sealing apparatus of claim 17, further comprising:

plate means disposed on opposite ends of said plurality of cups for providing a platform from which a further compressive load is applied to opposite ends of said plurality of cups in response to said compressive load applied to said plate means by said means for applying.

19. The sealing apparatus of claim 18, further comprising:

anchor means disposed adjacent each said plate means for gripping said well casing when said means for applying applies said compressive load to each said plate means thereby maintaining the application of said further compressive load from said plate means to said opposite ends of said plurality of cups, said plurality of cups remaining tightly interfit together and the well casing remaining sealed by the tightly interfit cups when said anchor means grips said well casing.

* * * * *